US006900381B2

(12) United States Patent
Lindgren et al.

(10) Patent No.: US 6,900,381 B2
(45) Date of Patent: May 31, 2005

(54) METHOD FOR REMOVING ALIASING IN WAVE TABLE BASED SYNTHESIZERS

(75) Inventors: Ulf Lindgren, Göteborg (SE); Alberto Jimenez Feltström, Málaga (ES); Thomas Jacobsson, Genarp (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 10/145,782

(22) Filed: May 16, 2002

(65) Prior Publication Data

US 2003/0033338 A1 Feb. 13, 2003

Related U.S. Application Data

(60) Provisional application No. 60/290,979, filed on May 16, 2001.

(51) Int. Cl.[7] ..... G10H 7/00

(52) U.S. Cl. ..... 84/603; 84/602; 84/609; 84/622; 708/315; 708/420

(58) Field of Search ..... 84/602–609, 622–625, 84/649, 659–661, DIG. 1, DIG. 9; 708/315, 420–421

(56) References Cited

U.S. PATENT DOCUMENTS

| | | | | |
|---|---|---|---|---|
| 4,643,067 A | * | 2/1987 | Deutsch | 84/607 |
| 4,715,257 A | | 12/1987 | Hoshiai et al. | |
| 5,086,475 A | * | 2/1992 | Kutaragi et al. | 704/265 |
| 5,111,727 A | | 5/1992 | Rossum | |
| 5,401,897 A | * | 3/1995 | Depalle et al. | 84/625 |
| 5,744,742 A | * | 4/1998 | Lindemann et al. | 84/623 |
| 5,814,750 A | | 9/1998 | Wang et al. | |

OTHER PUBLICATIONS

D.C. Massie, "Wavetable Sampling Synthesis," *Applications of Digital Signal Processing To Audio and Acoustics*, M. Kahrs et al. editors, Kluwer Academic Publishers, Boston/Dordrecht/London, 1998, pp. 311–341.

* cited by examiner

*Primary Examiner*—Marlon Fletcher
(74) *Attorney, Agent, or Firm*—Potomac Patent Group, PLLC

(57) ABSTRACT

A method and apparatus are provided for changing the pitch of a tabulated waveform in wavetable based synthesizers. Harmonics that normally would be aliased before a transposition process are removed by a discrete time low pass filter at the same time that the tabulated waveform is reconstruction and resampling.

23 Claims, 2 Drawing Sheets

METHOD FOR REMOVING ALIASING IN WAVE TABLE BASED SYNTHESIZERS

RELATED APPLICATIONS

This application claims benefit of priority from U.S. Provisional Application No. 60/290,979, filed on May 16, 2001, the entire disclosure of which is expressly incorporated herein by reference.

BACKGROUND OF THE INVENTION

1. Field of the Invention

The present invention relates to controlling distortion in reproduced digital data, and more particularly, to removing distortion in wavetable based synthesizers.

2. Description of the Related Art

The creation of musical sounds using electronic synthesis methods dates back at least to the late nineteenth century. From these origins of electronic synthesis until the 1970's, analog methods were primarily used to produce musical sounds. Analog music synthesisers became particularly popular during the 1960's and 1970's with developments such as the analog voltage controlled patchable analog music synthesiser, invented independently by Don Buchla and Robert Moog. As development of the analog music synthesiser matured and its use spread throughout the field of music, it introduced the musical world to a new class of timbres.

However, analog music synthesisers were constrained to using a variety of modular elements. These modular elements included oscillators, filters, multipliers and adders, all interconnected with telephone style patch cords. Before a musically useful sound could be produced, analog synthesizers have to be programmed by first establishing an interconnection between the desired modular elements and then laboriously adjusting the parameters of the modules by trial and error. Because the modules used in these synthesisers tended to drift with temperature change, it was difficult to store parameters and faithfully reproduce sounds from one time to another time.

Around the same time that analog musical synthesis was coming into its own, digital computing methods were being developed at a rapid pace. By the early 1980's, advances in computing made possible by Very Large Scale Integration (VLSI) and digital signal processing (DSP) enabled the development of practical digital based waveform synthesisers. Since then, the declining cost and decreasing size of memories have made the digital synthesis approach to generating musical sounds a popular choice for use in personal computers and electronic musical instrument applications.

One type of digital based synthesiser is the wavetable synthesiser. The wavetable synthesiser is a sampling synthesiser in which one or more musical instruments are "sampled," by recording and digitizing a sound produced by the instrument(s), and storing the digitized sound into a memory. The memory of a wavetable synthesizer includes a lookup table in which the digitized sounds are stored as digitized waveforms. Sounds are generated by "playing back" from the wavetable memory, to a digital-to-analog converter (DAC), a particular digitized waveform.

The basic operation of a sampling synthesiser is to playback digitized recordings of entire musical instrument notes under the control of a person, computer or some other means. Playback of a note can be triggered by depressing a key on a musical keyboard, from a computer, or from some other controlling device. While the simplest samplers are only capable of reproducing one note at a time, more sophisticated samplers can produce polyphonic (multi-tone), multi-timbral (multi-instrument) performances.

Data representing a sound in a wavetable memory are created using an analog-to-digital (ADC) converter to sample, quantize and digitize the original sound at a successive regular time interval (i.e., the sampling interval, $T_s$). The digitally encoded sound is stored in an array of wavetable memory locations that are successively read out during a playback operation.

One technique used in wavetable synthesizers to conserve sample memory space is the "looping" of stored sampled sound segments A looped sample is a short segment of a wavetable waveform stored in the wavetable memory that is repetitively accessed (e.g., from beginning to end) during playback. Looping is particularly useful for playing back an original sound or sound segment having a fairly constant spectral content and amplitude. A simple example of this is a memory that stores one period of a sine wave such that the endpoints of the loop segment are compatible (i.e., at the endpoints the amplitude and slope of the waveform match to avoid a repetitive "glitch" that would otherwise be heard during a looped playback of an unmatched segment). A sustained note may be produced by looping the single period of a waveform for the desired length of duration time (e.g., by depressing the key for the desired length, programming a desired duration time, etc.). However, in practical applications, for example, for an acoustic instrument sample, the length of a looped segment would include many periods with respect to the fundamental pitch of the instrument sound. This avoids the "periodicity" effect of a looped single period waveform that is easily detectable by the human ear and improves the perceived quality of the sound (e.g., the "evolution" or "animation" of the sound).

The sounds of many instruments can be modeled as consisting of two major sections: the "attack" (or onset) section and the "sustain" section. The attack section is the initial part of a sound, wherein amplitude and spectral characteristics of the sound may be rapidly changing. For example, the onset of a note may include a pick snapping a guitar string, the chiff of wind at the start of a flute note, or a hammer striking the strings of a piano. The sustain section of the sound is that part of the sound following the attack, wherein the characteristics of the sound are changing less dynamically. A great deal of memory is saved in wavetable synthesis systems by storing only a short segment of the sustain section of a waveform, and then looping this segment during playback.

Amplitude changes that are characteristic of a particular or desired sound may be added to a synthesized waveform signal by multiplying the signal with a decreasing gain factor or a time varying envelope function. For example, for an original acoustic string sound, signal amplitude variation naturally occurs via decay at different rates in various sections of the sound. In the onset of the acoustic sound (i.e., in the attack part of the sound), a period of decay may occur shortly after the initial attack section. A period of decay after a note is "released" may occur after the sound is terminated (e.g., after release of a depressed key of a music keyboard). The spectral characteristics of the acoustic sound signal may remain fairly constant during the sustain section of the sound, however, the amplitude of the sustain section also may (or may not) decay slowly. The forgoing describes a traditional approach to modeling a musical sound called the Attack-Decay-Sustain-Release (ADSR) model, in which a waveform is multiplied with a piecewise linear envelope function to simulate amplitude variations in the original sounds.

In order to minimize sample memory requirements, wavetable synthesis systems have utilized pitch shifting, or pitch transposition techniques, to generate a number of different notes from a single sound sample of a given instrument. Two types of methods are mainly used in pitch shifting: asynchronous pitch shifting and synchronous pitch shifting.

In asynchronous pitch shifting, the clock rate of each of the DAC converters used to reproduce a digitized waveform is changed to vary the waveform frequency, and hence its pitch. In systems using asynchronous pitch shifting, it is required that each channel of the system have a separate DAC. Each of these DACs has its own clock whose rate is determined by the requested frequency for that channel. This method of pitch shifting is considered asynchronous because each output DAC runs at a different clock rate to generate different pitches. Asynchronous pitch shifting has the advantages of simplified circuit design and minimal pitch shifting artifacts (as long as the analog reconstruction filter is of high quality). However, asynchronous pitch shifting methods have several drawbacks. First, a DAC would be needed for each channel, which increases system cost with increasing channel count. Another drawback of asynchronous pitch shifting is the inability to mix multiple channels for further digital post processing such as reverberation. Asynchronous pitch shifting also requires the use of complex and expensive tracking reconstruction filters—one for each channel—to track the sample playback rate for the respective channels.

In synchronous pitch shifting techniques currently being utilized, the pitch of the wavetable playback data is changed using sample rate conversion algorithms. These techniques accomplish sample rate conversion essentially by accessing the stored sample data at different rates during playback. For example, if a pointer is used to address the sample memory for a sound, and the pointer is incremented by one after each access, then the samples for this sound would be accessed sequentially, resulting in some particular pitch. If the pointer increment is two rather than one, then only every second sample would be played, and the resulting pitch would be shifted up by one octave (i.e., the frequency would be doubled). Thus, a pitch may be adjusted to an integer number of higher octaves by multiplying the index, n, of a discrete time signal x[n] by a corresponding integer amount a and playing back (reconstructing) the signal $x_{up}[n]$ at a "resampling rate" of an:

$$x_{up}[n]=x[an].$$

To shift downward in pitch, additional "sample" points (e.g., one or more zero values) are introduced between values of the decoded sequential data of the stored waveform. That is, a discrete time signal x[n] may be supplemented with additional values in order to approximate a resampling of the continuous time signal x(t) at a rate that is increased by a factor L:

$$x_{down}[n]=x[n/L],n=0,\pm L,\pm 2L,\ \pm 3L,\ \ldots;\ \text{otherwise},x_{down}[n]=0.$$

When the resultant sample points, $x_{down}[n]$, are played back at the original sampling rate, the pitch will have been shifted downward.

While the foregoing illustrates how the pitch may be changed by scaling the index of a discrete time signal by an integer amount, this allows only a limited number of pitch shifts. This is because the stored sample values represent a discrete time signal, x[n], and a scaled version of this signal, x[an] or x[n/b], cannot be defined with a or b being non integers. Hence, more generalized sample rate conversion methods have been developed to allow for more practical pitch shifting increments, as described in the following.

In a more general case of sample rate conversion, the sample memory address pointer would consist of an integer part and a fractional part, and thus the increment value could be a fractional number of samples. The memory pointer is often referred to as a "phase accumulator" and the increment value is called the "phase increment." The integer part of the phase accumulator is used to address the sample memory and the fractional part is used to maintain frequency accuracy.

Different algorithms for changing the pitch of a tabulated signal that allow fractional increment amounts have been proposed. See, for example, M. Kahrs et al., "Applications of Digital Signal Processing to Audio and Acoustics," 1998, pp. 311–341, the entire contents of which is incorporated herein by reference. One sample rate conversion technique disclosed in Kahrs et al. and currently used in computer music is called "drop sample tuning" or "zero order hold interpolator," and is the basis for the table lookup phase increment oscillator. The basic element of a table lookup oscillator is a wavetable, which is an array of memory locations that store the sampled values of waveforms to be generated. Once a wavetable is generated, a stored waveform may be read out using an algorithm, such as a drop sample tuning algorithm, which is described in the following.

First, assume that pre-computed values of the waveform may be stored in a wavetable denoted x, where x[n] refers to the value stored at location n of the wavetable. A variable Cph is defined as representing the current offset into the waveform and may have both an integer part and a fractional part. The integer part of the Cph variable is denoted as ⌊Cph⌋. (The notation ⌊z⌋ is used herein to denote the integer part of a real number z.) Next, let x[n], n=1, 2, . . . , BeginLoop−1, BeginLoop, BeginLoop+1, . . . , EndLoop−1, EndLoop, EndLoop+1, . . . , EndLoop+L be the tabulated waveform, and PitchDeviation be the amount of frequency the signal x[n] has to be shifted given in unit "cents."

A cent has its basis in the chromatic scale (used in most western music) and is an amount of a shift in pitch of a musical note (i.e., a relative change from a note's "old" frequency, $f_{old}$, to a "new" frequency,$f_{new}$). The chromatic scale is divided into octaves, and each octave, in turn, is divided into twelve steps (notes), or halftones. To move up an octave (+12 halftones) from a note means doubling the old frequency, and to move down an octave (−12 halftones) means halving the old frequency. When viewed on a logarithmic frequency scale, all the notes defined in the chromatic scale are evenly located. (One can intuitively understand the logarithmic nature of frequency in the chromatic scale by recalling that a note from a vibrating string is transposed to a next higher octave each time the string length is halved, and is transposed to a next lower octave by doubling the string length.) This means that the ratio between the frequencies of any two adjacent notes (i.e., halftones) is a constant, say c. The definition of an octave causes $c^{12}=2$, so that $c=2^{1/12}=1.059463$. It is usually assumed that people can hear pitch tuning errors of about one "cent," which is 1% of a halftone, so the ratio of one cent would be $2^{1/1200}$. For a given signal having a frequency $f_{old}$, if it is desired to shift $f_{old}$ to a new frequency $f_{new}$, the ratio of $f_{new}/f_{old}=2^{cents/1200}$ (note that 1200 cents would correspond to a shift up of one octave, −2400 cents would correspond to a shift down of 2 octaves, and so on). It follows that a positive value of cents indicates that $f_{new}$ is higher than $f_{old}$ (i.e., an upwards pitch shift), and that a negative value of cents indicates that $f_{new}$ is lower than $f_{old}$ (i.e., an downwards pitch shift).

The output of the drop sample tuning algorithm is y[n], and is generated from inputs x[n] and PitchDeviation, as follows:

Drop Sample Tuning Algorithm

Start:

$$PhaseIncrement = 2^{PitchDeviation/1200}$$

$$Cph = -PhaseIncrement$$

Loop:

$$Cph = \begin{cases} Cph + PhaseIncrement, & Cph \le EndLoop \\ BeginLoop & \text{else} \end{cases}$$

$$y[n] = x[\lfloor Cph \rfloor]$$

The algorithm output, y[n], is the value of x[.] indexed by the integer part of the current value of the variable Cph each time it cycles through the loop part of the algorithm. For example, with PhaseIncrement=1.0 (PitchDeviation=0 cents), each sample for the wavetable is read out in turn (for the duration of the loop), so the waveform is played back at its original sampling rate. With PhaseIncrement=0.5 (PitchDeviation=−1200 cents), the waveform is reproduced one octave lower in pitch. With PhaseIncrement=2.0 (PitchDeviation=1200 cents), the waveform is pitch shifted up by one octave, and every other sample is skipped. Thus, the sampled values of x[n] are "resampled" at a rate that corresponds to the value of PhaseIncrement. This resampling of x[n] is commonly referred to as "drop sample tuning," because samples are either dropped or repeated to change the frequency of the oscillator.

When PhaseIncrement is less than 1, the pitch of the generated signal is decreased. In principal, this is achieved by an up sampling of the wave data, but sustaining a fixed sampling rate for all outputs. Drop sample tuning "upsamples" x[n] and is commonly referred to as a "sampling rate expander" or an "interpolator" because the sample rate relative to the sampling rate used to form x[n] is effectively increased. This has the effect of expanding the signal in discrete time, which has the converse effect of contracting the spectral content of the original discrete time signal x[n].

When PhaseIncrement is greater than 1, the pitch of the signal is increased. In principal, this is achieved by a down sampling of the wave data, while sustaining a fixed sampling rate for all outputs. x[n] is commonly referred to as being "downsampled" or "decimated" by the drop sample tuning algorithm because the sampling rate is effectively decreased. This has the effect of contracting the signal in the time domain, which conversely expands the spectral content of the original discrete time signal x[n].

The drop sample tuning method of pitch shifting introduces undesirable distortion to the original sampled sound, which increases in severity with an increasing pitch shift amount. For example, if the pitch-shifting amount PhaseIncrement exceeds 1 and the original signal x(t) was sampled at the Nyquist rate, spectral overlapping of the downsampled signal will occur in the frequency domain and the overlapped frequencies will assume some other frequency values. This irreversible process is known as aliasing or spectral folding. A waveform signal that is reconstructed after aliasing has occurred will be distorted and not sound the same as a pitch-shifted version original sound. Aliasing distortion may be reduced by sampling the original sound at a frequency ($f_s=1/T_s$) that is much greater than the Nyquist rate such that the original sound is "over-sampled." However, over-sampling would require an increase in memory, which is undesirable in most practical applications.

To reduce the amount of aliasing distortion, interpolation techniques have been developed to change the sample rate. Adding interpolation in a sample rate conversion method changes the calculation of the lookup table by creating new samples based on adjacent sample values. That is, instead of ignoring the fractional part of the address pointer when determining the value to be sent to the DAC (such as in the foregoing drop sample algorithm), interpolation techniques perform a mathematical interpolation between available data points in order to obtain a value to be used in playback. The following algorithm illustrates a two point interpolation technique currently used in many sampling synthesizers to shift the pitch of a tabulated wavetable wave x[n]:

Linear Interpolation Algorithm

Start:

$$PhaseIncrement = 2^{PitchDeviation/1200}$$

$$Cph = -PhaseIncrement$$

Loop:

$$Cph = \begin{cases} Cph + PhaseIncrement, & Cph \le EndLoop \\ BeginLoop & \text{else} \end{cases}$$

$$y[n] = x[\lfloor Cph \rfloor] \cdot (1 - Cph + \lfloor Cph \rfloor) + x[\lfloor Cph \rfloor + 1] \cdot (Cph - \lfloor Cph \rfloor).$$

While interpolation methods reduce aliasing distortion to some extent when pitch-shifting wavetable waveforms, interpolation nevertheless introduces distortion that increases in severity as the sampling rate of the original waveform x(t) approaches (or falls below) the Nyquist rate. As with simple drop sample tuning, interpolation methods can more accurately represent the pitch-shifted version of the original sound if the Nyquist rate is greatly exceeded when creating x[n]. However, the tradeoff in doing so would necessarily require an increase in memory to store the corresponding increase in the number of wavetable samples. Higher order polynomial interpolation techniques may be used to further reduce aliasing distortion, but these techniques are computationally expensive. Thus, there is a need in the art for new ways of reducing distortion when tones listed in a wavetable are transposed without requiring a high levels of computation complexity and sample memory space.

SUMMARY OF THE INVENTION

Accordingly, the present invention is directed to a method and apparatus for shifting a pitch of a tabulated waveform that substantially obviates one or more of the shortcomings or problems due to the limitations and disadvantages of the related art.

In an aspect of the present invention, a first discrete time signal, x[n], may be processed to generate a second discrete time signal, y[m], wherein the signal x[n] comprises a sequence of values that corresponds to a set of sample points obtained by sampling a continuous time signal x(t) at successive time intervals $T_S$. Processing the first discrete time signal comprises generating a sequence of values, each of the values corresponding to a respective m of the second discrete time signal y[m], wherein each of the generated values is based on a value obtained by a convolution of the first discrete time signal x[n] with a sequence representing a discrete time low pass filter having a length based on a predetermined window length parameter L, the convolution being evaluated at one of successively incremented phase increment values multiplied by the sampling interval Ts and corresponding to a respective m value In another aspect of the present invention, an apparatus for processing first discrete time signal, x[n], to generate a second discrete time signal, y[m], wherein the signal x[n] comprises a sequence of values that corresponds to a set of sample points obtained by sampling a continuous time signal x(t) at successive time intervals $T_S$, comprises logic that generates a sequence of values, each of the values corresponding to a respective m of the second discrete time signal y[m], wherein each of the generated values is based on a value obtained by a convolution of the first discrete time signal x[n] with a sequence representing a discrete time low pass filter having a length based on a predetermined window length parameter L, the convolution being evaluated at one of successively incremented phase increment values multiplied by the sampling interval Ts and corresponding to a respective m value.

Additional aspects and advantages of the invention will be set forth in the description that follows, and in part will be apparent from the description, or may be learned from practice of the invention. The aspects and advantages of the invention will be realized and attained by the system and method particularly pointed out in the written description and claims hereof as well as the appended drawings.

It should be emphasized that the terms "comprises" and "comprising," when used in this specification, are taken to specify the presence of stated features, integers, steps or components, but the use of these terms does not preclude the presence or addition of one or more other features, integers, steps, components or groups thereof.

It is to be understood that both the foregoing general description and the following detailed description are exemplary and exemplary only and are not restrictive of the invention, as claimed.

BRIEF DESCRIPTION OF THE DRAWINGS

The accompanying drawings, which are included to provide a further understanding of the invention and are incorporated in and constitute a part of this specification, illustrate embodiments of the invention that together with the description serve to explain the principles of the invention. In the drawings.

DETAILED DESCRIPTION

These and other aspects of the invention will now be described in greater detail in connection with exemplary embodiments that are illustrated in the accompanying drawings.

The present invention is useful for shifting the pitch of a tone or note of a sampled sound in a wavetable based synthesizer without introducing aliasing distortion artifacts in the sound during playback. The present invention is particularly useful in computers or computer related applications which produce sound, such as electronic musical instruments, multimedia presentation, computer games, and PC-based sound cards. The term computers may include stationary computers, portable computers, radio connectable devices, such as Personal Data Assistants (PDAs), mobile phones and the like. The term radio connectable devices includes all equipment such as mobile telephones, pagers, communicators (e.g., electronic organizers, smartphones) and the like. The present invention may be implemented in any of the foregoing applications using the Musical Instrument Digital Interface (MIDI) protocol.

Figure 1A:
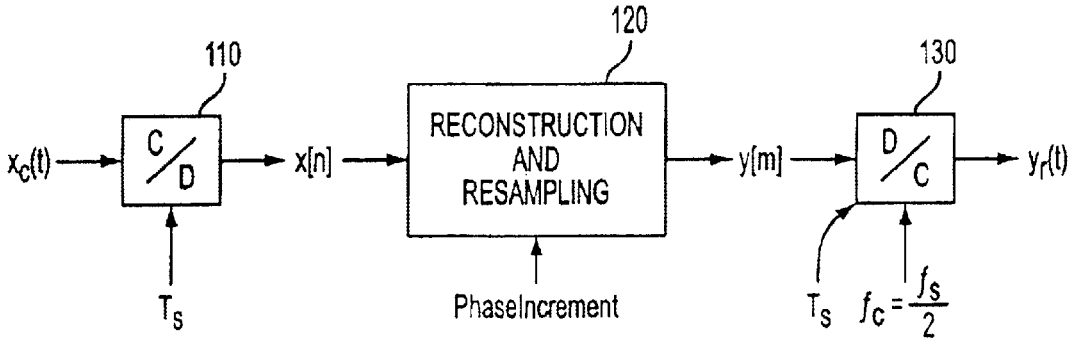
FIG. 1*a* is a system diagram in accordance with an exemplary embodiment of the present invention.

The method and apparatus of the present invention provide a way to remove the harmonics of a sound that would normally be aliased as a result of transposing a tone (or note) listed in a wavetable. FIG. 1*a* shows a general system 100 in which a continuous time signal is sampled to create a discrete time signal. Preferably, the sounds represent one or more instruments playing a musical note. However, the signal to be sampled may be of any sound capable of being sampled and stored as a discrete time signal. The discrete time signal is stored in a wavetable memory that is accessible via an incrementally advanced address pointer. Also input into system 100 is an amount of pitch shift that is desired for the continuous time signal upon playback.

In system 100, $x_c(t)$ is first sampled by continuous-to-discrete time (C/D) converter 110, such as an analog-to-digital converter, at a sampling period $T_s$. To avoid aliasing, the continuous time signal must be sampled at a rate, $f_s=1/T_s$, that is at least twice the bandwidth of the continuous time signal (i.e., the Nyquist rate, or equal to or greater than the highest frequency component of the signal that is desired to reproduce). The output of the C/D converter, x[n], is a discrete time version of the signal $x_c(t)$ and is stored as a waveform in a wavetable memory. When it is desired to playback the discrete time signal at a pitch that is transposed from the sampled pitch, the discrete time signal x[n] is input into the reconstruction and resampling means 120. Means 120 also receives a value, PhaseIncrement, that is based on the amount of desired shift in the relative pitch of the discrete time signal x[n]. The discrete time signal y[m], shown in FIG. 1*a* being output from the reconstruction and resampling means 120, is synthesized to approximate a resampled version of the original signal x[n]. The discrete output y[m] is then input to a D/C device 130 to form a continuous time signal, $y_r(t)$, which is a pitch-shifted version of the original signal $x_c[t]$.

Figure 1B:
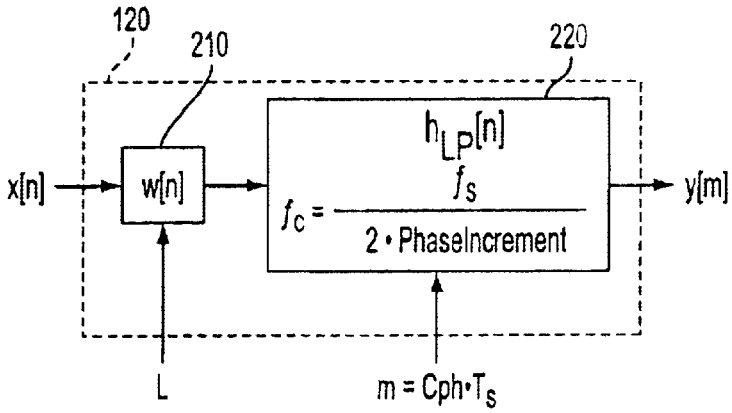
FIG. 1*b* is a system diagram of the resampling and reconstruction portion of FIG. 1*a*.

In accordance with an aspect of the invention, the reconstruction and resampling means 120 removes the harmonics that would be aliased during the transposition process. FIG. 1*b* shows more details of the functionality of the resampling means 120. As shown in FIG. 1*b*, window function is applied to a tabulated wave in a windowing means 210 and low pass filtered by low pass filtering means 220. According to the Nyquist Theorem, a lowpass bandlimited time continuous signal $y_r(t)$ can be reconstructed from a time-discrete version of itself, y[m], if it is sampled at a frequency $f_s$ higher than twice the bandwidth of the continuous time signal. In order to avoid aliasing, x(t) must be bandlimited, so the cutoff frequency, $f_c$, of the lowpass filter means 220 is set to be equal to $f_s/(2\cdot\text{PhaseIncrement})$. The reconstruction of $y_r(t)$ is then done by filtering y[m] with an ideal lowpass filter with passband $0-f_s/2$.

Therefore, given a time looped discrete time signal x[n], pitch shifting without aliasing can be accomplished in the following way:

1) reconstructing the time continuous signal $x_c(t)$ from x[n] without altering the pitch of $x_c(t)$;
2) limiting the bandwidth of the reconstructed signal $x_c(t)$ by filtering x(t) with a low-pass filter $h_{LP}(t)$; and
3) resampling the bandlimited signal, i.e., the signal:

$$y(t)=x(t)*h_{LP}(t).$$

Processes 1) to 3) are respectively represented mathematically as follows:

$$\text{I)}\ x_c(t) = \sum_{n=-\infty}^{\infty} x[n]\frac{1}{T_s}\sin\frac{\pi}{T_s}\frac{(t-nT_s)}{\frac{\pi}{T_s}(t-nT_s)} = f_s\sum_{n=-\infty}^{\infty} x[n]\frac{\sin\pi f_s(t-nT_s)}{\pi f_s(t-nT_s)}$$

To compute an arbitrary sample point on a continuous and bandlimited waveform, the reconstruction formula can be used:

$$x_c(t_0) = f_s\sum_{n=-\infty}^{\infty} x[n]\text{sinc}(f_s\pi(t_0-nT_s)), \qquad \text{(Equation 1)}$$

where $$\text{sinc}(x)=(\sin(x))/x \qquad \text{(Equation 2)}$$

Now, assume that a waveform x[n] is stored as a sequence of M+1 samples and the sample points are time instances $kT_s$, where k=0, 1, 2, . . . , M. Further assume that the waveform has a bandwidth of $B=1/(2T_s)$. Given these assumptions and the event of increasing the pitch of the waveform, aliasing would occur using Equation I. This happens because a pitch increase will correspond to a number of samples that is lower than M+1. The effect of this is that of sampling the original time continuous signal $x_c(t)$ at a lower sampling rate. Hence, lowpass filtering would be required to avoid the aliasing:

$$y(t)=x(t)*h_{LP}(t) \qquad \text{(Equation 3)}$$

Inserting Equation I into Equation 3 results in:

$$\text{II)}\ y(t) = f_s\sum_{n=-\infty}^{\infty} x[n]\int_{-\infty}^{\infty} h_{LP}(u)\frac{\sin\pi f_s(u-t+nT_s)}{\pi f_s(u-t+nT_s)}du$$

An arbitrary number of points can be collected given an appropriate choice for a filter. Finally, it can be concluded that:

$$y[m]=y(t)|_{t=m\cdot\gamma\cdot T} \qquad \text{III)}$$

where m is an integer advancing the sampling instance, γ is the phase increment (also referred to herein as PhaseIncrement) and $T_s=1/f_s$ is the sampling interval used when recording x[n]. Hereafter, m·γ is denoted as Cph. Thus, y[m] may be viewed as being a reconstructed (continuous time) and bandlimited version of x[n] resampled at successive times $\text{Cph}\cdot T_s$.

Unfortunately, the theoretical reconstruction of y(t) requires an infinite number of calculations. Furthermore, the integral of the convolution can be cumbersome to compute. The complexity of this method may be lowered in the following ways:

Case A: Shifting up the Pitch of x[n]

1) Include a low pass filter in the reconstruction formula; and
2) Use a window function w[n] in the reconstruction formula.

In Case A, the upwards shift in pitch corresponds to a value of PhaseIncrement>1 (here we use the same variables of the previously described drop sample tuning and interpolation algorithms). The window w[n] is a finite duration window such as a rectangular window. Alternatively, other types of windows may be used, such as a Bartlett, Hanning, Hamming and Kaiser windows. Windowing the reconstruction formula allows for a finite number of calculations to compute the resampled points. The following is an exemplary equation that may be used to compute sample points of a phase shifted version of x[n] when PhaseIncrement>1:

$$y[m] = \frac{f_s}{PhaseIncrement}\sum_{n=-\infty}^{\infty} x[\lfloor Cph-n\rfloor]w\left[\frac{Cph-\lfloor Cph\rfloor+n}{PhaseIncrement}\right]\frac{\sin\frac{\pi(Cph-\lfloor Cph\rfloor+n)}{PhaseIncrement}}{\frac{\pi(Cph-\lfloor Cph\rfloor+n)}{PhaseIncrement}},$$

where $$y[m]=y(t)|_{t=m\cdot\gamma\cdot T_S},$$

m is an integer, and Cph is equal to m·γ. Since ⌊Cph⌋+n=⌊Cph+n⌋ when n is an integer, by including n within ⌊Cph⌋ in the argument of the window function, one can see that x[] is convolved with the window "w[]" multiplied by an ideal low pass reconstruction filter, or "interpolation function" (i.e., the "sinc[]" function)). The continuous filtering has been changed to discrete time filtering. If this is the case, one can circumvent the continuous filtering in Equation II) and replace it with a discrete filter. A window function may be used to truncate the low pass reconstruction filter (i.e., "sinc[]") and thus allow a finite number of computations to approximate y[m].

Case B: Shifting Down the Pitch of x[n]

When shifting down the pitch of x[n], the low pass filter is not needed. However, because the digital energy of a signal is inversely proportional to the number of samples included in the waveform, the digital energy of an upsampled waveform (i.e., when the phase increment is less than 1) decreases as a result of additional samples created. Therefore signal must be scaled to retain the same power level as the waveform x[n]. Thus, the equation for shifting x[n] down in pitch may take the following form:

$$y[m] = \frac{f_s}{PhaseIncrement}$$

-continued $$\sum_{n=-\infty}^{\infty} x[\lfloor Cph-n\rfloor]w[Cph-\lfloor Cph\rfloor+n]\frac{\sin\pi(Cph-\lfloor Cph\rfloor+n)}{\pi(Cph-\lfloor Cph\rfloor+n)}$$

for PhaseIncrement≦1, where the energy scaling factor is 1/PhaseIncrement. (In both cases A and B, the substitution n=⌊Cph⌋−k is made to center the sum around ⌊Cph⌋).

In a typical implementation, the windowed reconstruction formula and the factor 1/PhaseIncrement could be tabulated for reducing the computation time. If a symmetrical rectangular window of height 1 and length 2L+1 is used, the result would be:

$$y[m]=\frac{f_s}{PhaseIncrement}\sum_{n=-L}^{L} x[\lfloor Cph\rfloor-n]\text{table}\left[\text{round}\left(\frac{Cph-\lfloor Cph\rfloor+n}{\beta\cdot PhaseIncrement}\right)\right] \quad \text{(Equation A)}$$

for PhaseIncrement>1, and β>0 is an extra parameter normally set to one, but may be set to other values to allow more flexible bandlimitation; otherwise $$y[m]=\frac{f_s}{PhaseIncrement}\sum_{n=-L}^{L} x[\lfloor Cph\rfloor-n]\text{table}[\text{round}(Cph-\lfloor Cph\rfloor+n)] \quad \text{(Equation B)}$$

wherein in both Equation A and Equation B, the entry stored at table[round(k)] is sin(πk)/(πk).

Figure 2:
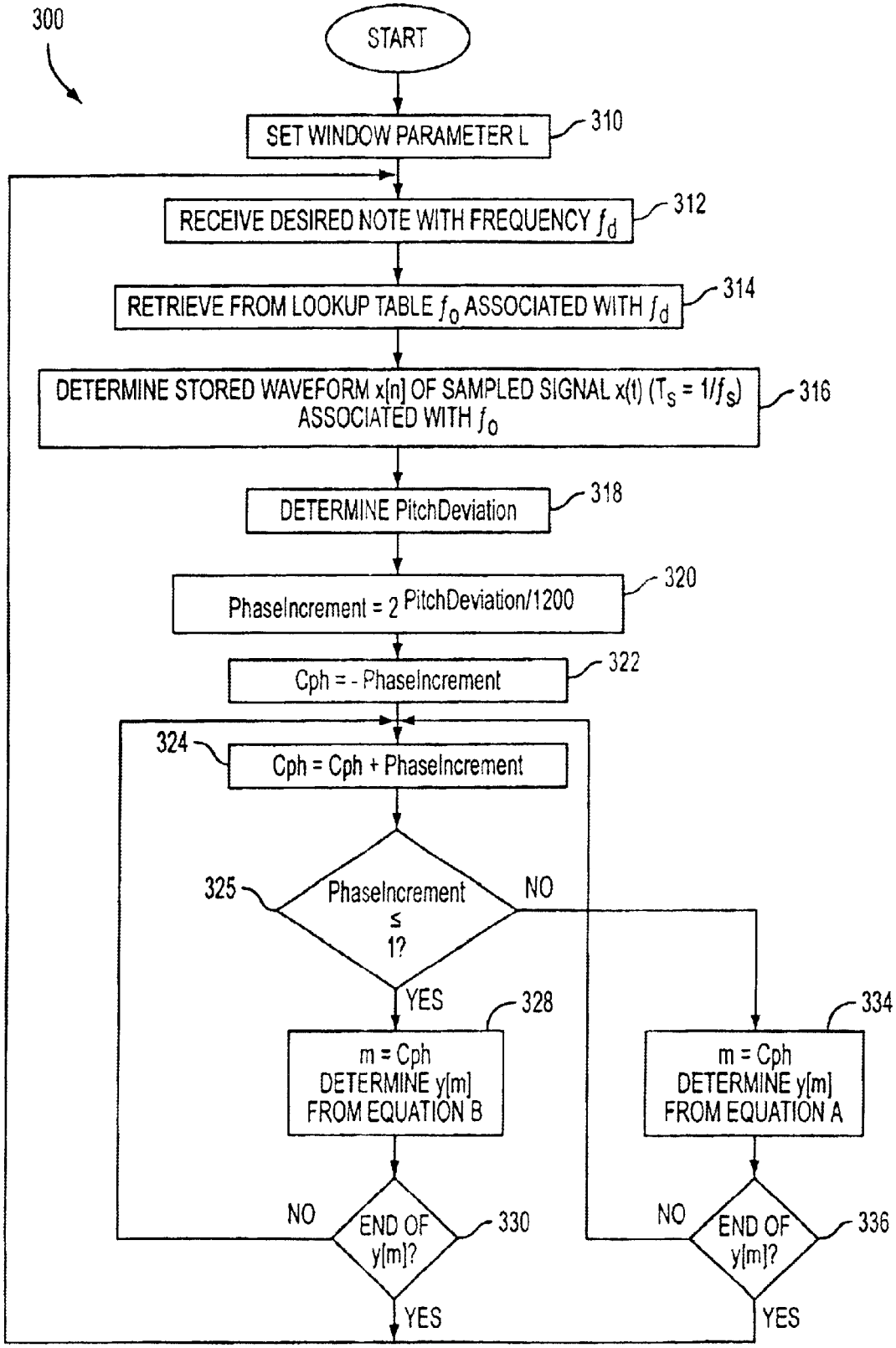
FIG. 2 is a flowchart illustrating exemplary processes in accordance with the present invention.

FIG. 2 is a flowchart of an exemplary process 300 for producing a desired note or tone using a discrete time waveform x[n] that has been stored in a wavetable synthesizer memory. It is assumed that the stored waveform x[n] represents a sound, for example, a note played on a particular musical instrument, that has been recorded by sampling the sound at a rate equal to or exceeding the Nyquist rate (i.e., at a sampling frequency equal to or greater than twice the highest frequency component that is desired to reproduce), and that the samples have been digitized and stored in the wavetable memory.

Each digitized waveform x[n] is associated with a frequency value, $f_0$, such as the fundamental frequency of a reconstructed version of the stored sound when played back at the recorded sampling rate. The frequency value $f_0$ may be stored in a lookup table associated with the wavetable memory, wherein each $f_0$ points to an address of a corresponding waveform x[n] stored in the memory. The stored value associated with an $f_0$ may be arranged in a list including one or more different fundamental frequency values (e.g., a plurality of $f_0$ values, each one associated with a respective one of a plurality of notes) of a same waveform type (e.g., a horn, violin, piano, voice, pure tones, etc.). Each of the listed $f_0$ values may be associated with an address of a stored waveform x[n] representing the original sound x(t) recorded (sampled) while being played at that pitch ($f_0$).

Of course, the wavetable memory may include many stored waveform types and/or include several notes of each specific waveform type that were recorded at different pitches at the sampling rate (e.g., one note per octave) in order to reduce an amount of pitch shift that would be required to synthesize a desired note (or tone) at frequency, $f_d$. It is to be understood that the desired frequency $f_d$ may be expressed as a digital word in a coded bit stream, wherein a mapping of digital values of $f_d$ to an address of a discrete waveform x[n] stored in the wavetable memory has been predetermined and tabulated into a lookup table. Alternatively, the synthesizer may include a search function that finds the best discrete waveform x[n] based on a proximity that $f_d$ may have to a value of $f_0$ associated with a stored waveform x[n], or by using another basis, such as to achieve a preset or desired musical effect.

The mapping $f_d$ to a discrete time signal x[n] (i.e., a sampled version of a continuous time signal having frequency $f_0$), which in playback is to be shifted in pitch to the desired frequency, $f_d$, may (or may not) depend on whether a particular waveform has a preferred reconstructed sound quality when shifted up from an $f_0$, or when shifted down from an $f_0$ to the desired frequency $f_d$. For example, a high quality reproduction of a particular note of a waveform type may require sampling and storing in the wavetable memory several original notes (e.g., a respective $f_0$ for each of several notes, say A, C and F, for each octave of a piano keyboard). It may be the case that better reproduced quality sound may be achieved for a particular waveform by only shifting up (or down) from a particular stored $f_0$ close to the desired note (or tone).

For purposes of explaining the invention, the process 300 shown in FIG. 2 includes retrieving from a lookup table (e.g., a waveform type list) a value of $f_0$, which in turn is associated with a particular discrete time signal x[n] stored in the wavetable, and then shifting the pitch of the waveform that is reproduced from x[n] in the direction of $f_d$. However, those skilled in the art will appreciate from the foregoing description that a number of different ways may be utilized to choose a particular discrete time signal (and thus also determine the resulting shift direction required) when it is desired to synthesize a note of a frequency $f_d$. For example, a desired note may simply be a note associated with a specific key on a keyboard of a synthesizer system operating in a mode in which depressing the key associates a particular discrete time waveform x[n] stored in the wavetable directly to a predetermined PhaseIncrement amount. It is to be understood that while the processes of FIG. 2 are shown in flowchart form, some of the processes may be performed simultaneously or in a different order than as depicted.

FIG. 2 shows an exemplary process 300 that may be used in a wavetable synthesizer system in accordance with the invention. As shown in FIG. 2, process 300 begins by setting the window length parameter L. The value of parameter L may be preset in accordance with a particular application requirement. Alternatively, L may be varied by the system depending on a current processing load of the system, or an L parameter value may be stored in the system memory and associated with a particular pitch shift. High values of window parameter L generally provide for better resolution of y[m], but a high L value increases computation time. Conversely, lower L parameter values may provide quicker computation, but result in a more coarse approximation of a resampled continuous time signal.

In process 312, the system receives a desired frequency $f_d$ of a note intended for playback. The desired frequency $f_d$ may be associated with a symbol of a computer language used by a composer programming a musical performance, a signal received when an instrument keyboard is depressed, or some other type of input to the synthesizer indicating that a note at frequency $f_d$ is requested for playback. A particular waveform type also may be indicated with the value $f_d$. As a result of receiving the desired frequency $f_d$ (and waveform type), in process 314 the system retrieves a value$f_0$) from a lookup table. The value $f_0$ may be included in one or more lists of different waveform types respectively associated with different instruments or sound timbre (e.g., the note "middle A" will be in lists associated with both violin and piano). The lookup table may be included in the wavetable memory or it may reside elsewhere. In step 316, the $f_0$ value determined in process 314 is associated with a particular waveform x[n] stored in the wavetable memory. The waveform x[n] is a tabulated waveform including values of a continuous time signal $x_c(t)$ that have been sampled at sampling interval $T_s=1/f_s$. In processes 318 and 320, variables PitchDeviation and PhaseIncrement are defined and computed. It is to be understood that values for PitchDeviation and/or PhaseIncrement values may be tabulated for quick lookup. For example, a PitchDeviation value associated with a received digital code indicating both "piano" (type) and "middle $C^{\#}$"(and associated desired $f_d$) can be readily tabulated if a waveform associated with "middle C" or some other relative pitch is stored in the wavetable memory as a discrete waveform x[n] with a known playback frequency $f_0$.

In process 322, parameter Cph is defined and initialized to -PhaseIncrement. In process 324, Cph is incremented by the value PhaseIncrement. In decision block 325, the value of PhaseIncrement is compared to 1. If PhaseIncrement is less than or equal to 1 (i.e., meaning that when PhaseIncrement is less than or equal to 1, the continuous time signal $x_c(t)$ represented by x[n] is effectively resampled at a rate equal to or higher than the original sampling rate $T_s$, and the resulting waveform y[m], when reproduced at $T_s$, has a pitch that is either equal to the original recorded pitch of $x_c(t)$ (corresponding to when PhaseIncrement=1) or a lower pitch than $x_c(t)$ (corresponding to when PhaseIncrement<1)). Then, in process 328, y[m] is determined using Equation B.

In process 330, it is determined whether all the desired samples for y[m] have been determined. If it is determined that y[m] is has not finished, the process loops back to repeat processes 324, 325 and 328 until the desired number of samples is reached. The number of y[m] values to be computed for each PhaseIncrement value could be decided in a number of ways. One means to interrupt the computations is by an external signal instructing the waveform generator to stop. For example, such an external signal may be passed on the reception of a key-off message, which is a MIDI command. However, as long as a key is pressed down, the sample generation continues. The waveform data x[k] may be stored as a circular buffer modulus K. Thus, the original x[k] data is retrieved by increasing an integer. This integer can be, for example, the integer part of Cph computed in block 324 (e.g., as used in the drop sample algorithm). Evidently, when K+1 is reached, the sample x[0] is reached, mimicking a periodic discrete time signal.

An outer control system surrounding the algorithm for pitch shifting may require very rapid changes in pitch (e.g., due to MIDI commands such as pitch modulation, pitch bend, etc.). In this case, the number of y[m] values may be as low as 1 calculated value for each phase increment. For example, in addition to altering the pitch increment by pressing various keys on a synthesizer keyboard, a pitch wheel or other mechanism is often used on synthesizers to alter a pitch increment. Altering the pitch wheel should be reflected by new pitch deviation values, for example, passed on the fly to the wave generating algorithm. In such a case, the passed deviation would be relative to that currently in use by the wave generator. That is, an additional variables may be defined as follows: TotPitchDev=PitchDevNote+PitchDevWheel. In other exemplary systems (or modes of operation) requiring relatively low demands with respect to resolution (in the time domain), it may be sufficient to calculate a block including a relatively low number of values for each phase increment. Thus, in a typical application, the surrounding system may decide how many values of y[m] to calculate in order to obtain the desired resolution of possible pitch changes.

In process 330, if it is determined that all the desired samples for y[m] have not been determined, the "NO" path is taken and the process loops back to repeat processes 324, 325 and 328. It should be understood that the phase increment may be changed at any time and in a variety of ways relative to the received note (e.g., see the "on the fly" operation described above). The looping back passed decision block 325 to process 324 (and also from the "NO" path out of decision block 336 back to process 324) allows for appropriate processing of these changes.

If in process 325 it is determined that PitchDeviation is greater than 1 (i.e., meaning that when PhaseIncrement is greater than 1, the continuous time signal $x_c(t)$ represented by x[n] is effectively resampled at a rate lower than the original sampling rate $T_s$, and the resulting waveform y[m], when reproduced at $T_s$, has a pitch that is higher than the original recorded pitch of $x_c(t)$), then in process 334, y[m] is determined using Equation A, which is a bandlimited discrete time pitch shifted version of x[n].

Process 336 is similar to process 330, except that y[m] is an up-shifted in pitch and bandlimited as a result of process 334. Alternatively, processes 330 and 336 may be combined into a single process (not shown). When all desired values of y[m] are computed and played back, then the "YES" path is taken out of the respective decision blocks 330 and 336, and the process loops back to block 312 where it waits to receive the next desired note (i.e., waveform type and frequency $f_d$).

To facilitate an understanding of the invention, many aspects of the invention have been described in terms of sequences of actions to be performed by elements of a computer system. It will be recognized that in each of the embodiments, the various actions could be performed by specialized circuits (e.g., discrete logic gates interconnected to perform a specialized function), by program instructions being executed by one or more processors, or by a combination of both. Moreover, the invention can additionally be considered to be embodied entirely within any form of computer readable carrier, such as solid-state memory, magnetic disk, optical disk or carrier wave (such as radio frequency, audio frequency or optical frequency carrier waves) containing an appropriate set of computer instructions that would cause a processor to carry out the techniques described herein. Thus, the various aspects of the invention may be embodied in many different forms, and all such forms are contemplated to be within the scope of the invention. For each of the various aspects of the invention, any such form of embodiments may be referred to herein as "logic configured to" perform a described action, or alternatively as "logic that" performs a described action.

The invention has been described with reference to particular embodiments. However, it will be readily apparent to those skilled in the art that it is possible to embody the invention in specific forms other than those of the preferred embodiment described above. This may be done without departing from the spirit of the invention.

It will be apparent to those skilled in the art that various changes and modifications can be made in the method for removing aliasing in wavetable based synthesizers of the present invention without departing from the spirit and scope thereof. Thus, it is intended that the present invention cover the modifications of this invention provided they come within the scope of the appended claims and their equivalents.

What is claimed is:

1. A method of processing a first discrete time signal, x[n], to generate a second discrete time signal, y[m], wherein the signal x[n] comprises a sequence of values that corresponds to a set of sample points obtained by sampling a continuous time signal x(t) at successive time intervals $T_s$, the method comprising the steps of:

storing a windowed function in a look-up table;

sampling said windowed function to generate a filter function representing a discrete low pass filter having a length based on a predetermined window length parameter L; and generating a sequence of values, each of the values corresponding to a respective m of the second discrete time signal y[m], wherein each of the generated values is based on a value obtained by computing a convolution sum of values of the first discrete time signal x[n] with said filter function, the convolution sum being computed at one of successively incremented phase increment values multiplied by the sampling interval Ts and corresponding to a respective m value and being centered around a product of the phase increment value and the respective m value.

2. The method according to claim 1, wherein the pitch of y[m] is different than the pitch of x[n] by an amount corresponding to the phase increment value.

3. The method of claim 1, wherein the step of generating the second discrete time signal, y[m], from the first discrete time continuous signal x[n] comprises: determining whether the pitch of the first discrete-valued signal, x[n], is to be raised or lowered; if the pitch of the first discrete-valued signal, x[n], is to be raised, then generating the second discrete time signal, y[m], from the first discrete time signal, x[n], by limiting the bandwidth of the first discrete time signal, x[n]; and if the pitch of the first discrete-valued signal, x[n], is to be lowered, then generating the second discrete time signal, y[n], from the first discrete time signal, x[n], without limiting the bandwidth of the first discrete time signal, x[n].

4. The method of claim 3, wherein if it is determined that the pitch of the first discrete-valued signal, x[n], is to be raised, then for each successive m, the determined value of y[m] is approximately:

$$y[m] = \frac{f_s}{\gamma}\sum_{n=-L}^{L} x[\lfloor m\gamma\rfloor - n]\,\mathrm{sinc}\left(\frac{\pi}{\gamma}(m\gamma - \lfloor m\gamma\rfloor + n)\right)$$

where γ is the phase increment, $f_2=1/T_s$, sinc(·)=(sin(·))/(·), and ⌊mγ⌋ denotes the integer part of m·γ.

5. The method of claim 3, wherein if it is determined that the pitch of the first discrete-valued signal, x[n], is to be lowered, then for each successive m, the determined value of y[m] is approximately:

$$y[m] = \frac{f_s}{\gamma}\sum_{n=-L}^{L} x[\lfloor m\gamma\rfloor - n]\,\mathrm{sinc}(\pi(m\gamma - \lfloor m\gamma\rfloor + n))$$

where γ is the phase increment, $f_S=1/T_s$, sinc(·)=(sin(·))/(·), and ⌊mγ⌋ denotes the integer part of m·γ.

6. The method of claim 1, wherein the step of generating the second discrete-valued signal, y[m], from the first discrete time signal, x[n], further comprises scaling the determined values of the second discrete time signal, y[m] such that the second discrete time signal, y[m] has a same power level as a power level of the first discrete-valued signal, x[n].

7. The method of claim 1, further comprising: generating a continuous time signal y(t) from the sequence of generated values of the discrete time signal y[m], wherein the pitch of y(t) is different than the pitch of the continuous time signal x(t) by an amount corresponding to the phase increment value.

8. The method of claim 1, wherein said step of sampling a windowed function further comprises the step of:

sampling said windowed function stored in said look-up table in a manner wherein said filter function operates to provide a sampling rate change in y[m] relative to x[n] without introducing substantial aliasing in y[m].

9. An apparatus for processing a first discrete time signal, x[n], to generate a second discrete time signal, y[m], wherein the signal x[n] comprises a sequence of values that corresponds to a set of sample points obtained by sampling a continuous time signal x(t) at successive time intervals $T_s$, the apparatus comprising:

a look-up table for storing a windowed function;

logic that samples said windowed function to generate a filter function a sequence representing a discrete time low pass filter havin a length based on a predetermined window length parameter L;

logic that generates a sequence of values, each of the values corresponding to a respective m of the second discrete time signal y[m], wherein each of the generated values is based on a value obtained by said logic computing a convolution sum of values of the first discrete time signal x[n] with said filter function, the convolution sum being computed at one of successively incremented phase increment values multiplied by the sampling interval Ts and corresponding to a respective m value and being centered around a product of the phase increment value and the respective m value.

10. The apparatus of claim 9, wherein the logic that generates a sequence of values, each of the values corresponding to a respective m of the second discrete time signal y[m] comprises:

logic that determines whether the pitch of the first discrete-valued signal, x[n], is to be raised or lowered;

logic that generates the second discrete time signal, y[m], from the first discrete time signal, x[n] if the pitch of the first discrete-valued signal, x[n], is to be raised, wherein the second discrete time signal, y[m], is generated from the first discrete time signal, x[n], by limiting the bandwidth of the first discrete time signal, x[n]; and logic that generates the second discrete time signal, y[m], from the first discrete time signal, x[n], if the pitch of the first discrete-valued signal, x[n], is to be lowered, wherein the second discrete time signal, y[m], is generating without limiting the bandwidth of the first discrete time signal, x[n].

11. The apparatus of claim 10, wherein if the logic that generates the second discrete time signal, y[m], determines that the pitch of the first discrete-valued signal, x[n], is to be raised, then for each successive m, the logic that generates the second discrete time signal, y[m], generates a value of y[m] that is approximately:

$$y[m] = \frac{f_s}{\gamma}\sum_{n=-L}^{L} x[\lfloor m\gamma \rfloor - n]\mathrm{sinc}\left(\frac{\pi}{\gamma}(m\gamma - \lfloor m\gamma \rfloor + n)\right)$$

where $\gamma$ is the phase increment, $f_s=1/T_s$, $\mathrm{sinc}(\cdot)=(\sin(\cdot))/(\cdot)$, and $\lfloor m\gamma \rfloor$ denotes the integer part of $m\cdot\gamma$.

12. The apparatus of claim 10, wherein if the logic that generates the second discrete time signal, y[m], determines that the pitch of the first discrete-valued signal, x[n], is to be lowered, then for each successive m, the logic that generates the second discrete time signal, y[m], generates a value of y[m] that is approximately:

$$y[m] = \frac{f_s}{\gamma}\sum_{n=-L}^{L} x[\lfloor m\gamma \rfloor - n]\mathrm{sinc}(\pi(m\gamma - \lfloor m\gamma \rfloor + n))$$

where $\gamma$ is the phase increment, $f_s=1/T_s$,$\mathrm{sinc}(\cdot)=(\sin(\cdot))/(\cdot)$, and $\lfloor m\gamma \rfloor$ denotes the integer part of $m\cdot\gamma$.

13. The apparatus of claim 9, wherein the logic that generates the second discrete time signal, y[m], further comprises logic for scaling the determined values of the second discrete time signal, y[m] such that the second discrete time signal, y[m] has a same power level as a power level of the first discrete-valued signal, x[n].

14. The apparatus of claim 9, further comprising:

logic that generating a continuous time signal y(t) from the sequence of generated values of the discrete time signal y[m], wherein the pitch of y(t) is different than the pitch of the continuous time signal x(t) by an amount corresponding to the phase increment value.

15. The apparatus of claim 9, wherein said logic that samples said windowed function operates to sample said windowed function in a manner wherein said filter function operates to provide a sampling rate change in y[m] relative to x[n] without introducing substantial aliasing in y[m].

16. A computer-readable medium having stored thereon a plurality of instructions which, when executed by a processor in a computer system, cause the processor to perform acts to process a first discrete time signal, x[n], to generate a second discrete time signal, y[m], wherein the signal x[n] comprises a sequence of values that corresponds to a set of sample points obtained by sampling a continuous time signal x(t) at successive time intervals $T_s$, the acts comprising the steps of:

storing a windowed function in a look-up table;

sampling said windowed function to generate a filter function representing a discrete low pass filter having a length based on a predetermined window length parameter L; and generating a sequence of values, each of the values corresponding to a respective m of the second discrete time signal y[m], wherein each of the generated values is based on a value obtained by computing a convolution sum of values of the first discrete time signal x[n] with said filter function, the convolution sum being computed at one of successively incremented phase increment values multiplied by the sampling interval $T_s$ and corresponding to a respective m value and being centered around a product of the phase increment value and the respective m value.

17. The computer-readable medium according to claim 16, wherein the pitch of y[m] is different than the pitch of x[n] by an amount corresponding to the phase increment value.

18. The computer-readable medium of claim 16, wherein the plurality of instructions that cause the processor to perform acts to generate the second discrete time signal, y[m], from the first discrete time continuous signal, x[n], comprises instructions that cause the processor to perform the acts of:

determining whether the pitch of the first discrete-valued signal, x[n], is to be raised or lowered;

if the pitch of the first discrete-valued signal, x[n], is to be raised, then generating the second discrete time signal, y[m], from the first discrete time signal, x[n], by limiting the bandwidth of the first discrete time signal, x[n]; and if the pitch of the first discrete-valued signal, x[n], is to be lowered, then generating the second discrete time signal, y[n], from the first discrete time signal, x[n], without limiting the bandwidth of the first discrete time signal, x[n].

19. The computer-readable medium of claim 18, wherein if it is determined that the pitch of the first discrete-valued signal, x[n], is to be raised, then for each successive m, the instructions cause the processor to generate the value of y[m]to be approximately:

$$y[m] = \frac{f_s}{\gamma}\sum_{n=-L}^{L} x[\lfloor m\gamma \rfloor - n]\mathrm{sinc}\left(\frac{\pi}{\gamma}(m\gamma - \lfloor m\gamma \rfloor + n)\right)$$

where $\gamma$ is the phase increment, $f_s=1/T_2$,$\mathrm{sinc}(\cdot)=(\sin(\cdot))/(\cdot)$, and $\lfloor m\gamma \rfloor$ denotes the integer part of $m\cdot\gamma$.

20. The computer-readable medium of claim 18, wherein if it is determined that the pitch of the first discrete-valued signal, x[n], is to be lowered, then for each successive m, the instructions cause the processor to generate the value of y[m] to be approximately:

$$y[m] = \frac{f_s}{\gamma}\sum_{n=-L}^{L} x[\lfloor m\gamma \rfloor - n]\mathrm{sinc}(\pi(m\gamma - \lfloor m\gamma \rfloor + n))$$

where $\gamma$ is the phase increment, $f_s=1/T_s$,$\mathrm{sinc}(\cdot)=(\sin(\cdot))/(\cdot)$, and $\lfloor m\gamma \rfloor$ denotes the integer part of $m\cdot\gamma$.

21. The computer-readable medium of claim 16, wherein the plurality of instructions that cause the processor to perform acts to generate the second discrete-valued signal, y[m], from the first discrete time signal, x[n], comprises instructions that cause the processor to perform the acts of scaling the determined values of the second discrete time signal, y[m] such that the second discrete time signal, y[m] has a same power level as a power level of the first discrete-valued signal, x[n].

22. The computer-readable medium of claim 16, wherein the plurality of instructions comprises instructions that cause the processor to perform the acts of:

generating a continuous time signal y(t) from the sequence of generated values of the discrete time signal y[m], wherein the pitch of y(t) is different than the pitch of the continuous time signal x(t) by an amount corresponding to the phase increment value.

23. The computer-readable medium of claim 16, wherein said step of sampling a windowed function further comprises the step of:

sampling said windowed function stored in said look-up table in a manner wherein said filter function operates to provide a sampling rate change in y[m] relative to x[n] without introducing substantial aliasing in y[m].

* * * * *

UNITED STATES PATENT AND TRADEMARK OFFICE

CERTIFICATE OF CORRECTION

PATENT NO. : 6,900,381 B2 
DATED : May 31, 2005
INVENTOR(S) : Ulf Lindgren, Jimenez Felström and Thomas Jacobsson It is certified that error appears in the above-identified patent and that said Letters Patent is hereby corrected as shown below:

Column 2,
Line 14, change "sound segment A looped" to -- sound segment. A looped --.

Column 9,
Line 27, change "
$$\sum_{n=-\infty}^{\infty} x[n]\frac{1}{T_S}\sin\frac{\pi}{T_S}\frac{(t-nT_S)}{\frac{\pi}{T_S}(t-nT_S)} = f_S\sum_{n=-\infty}^{\infty} x[n]\frac{\sin \pi f_S(t-nT_S)}{\pi f_S(t-nT_S)}$$
"

to --
$$\sum_{n=-\infty}^{\infty} x[n]\frac{1}{T_S}\frac{\sin\frac{\pi}{T_S}(t-nT_S)}{\frac{\pi}{T_S}(t-nT_S)} = f_S\sum_{n=-\infty}^{\infty} x[n]\frac{\sin \pi f_S(t-nT_S)}{\pi f_S(t_{T_S}-nT_S)}$$
--.

Line 67, change "
$$y[m]=y(t)\Big|_{t=m\cdot\gamma\cdot T} \qquad \text{III)}$$
" to --
$$\text{III) } y[m]=y(t)\Big|_{t=m\cdot\gamma\cdot T_S}$$
--.

Column 16,
Line 25, change "havin" to -- having --.

Signed and Sealed this

Twenty-second Day of November, 2005

JON W. DUDAS
*Director of the United States Patent and Trademark Office*